US005630520A

United States Patent [19]

Luch et al.

[11] Patent Number: 5,630,520

[45] Date of Patent: May 20, 1997

[54] TABS FOR CONTAINER CLOSURES AND CONTAINER NECK

[75] Inventors: Daniel Luch, Morgan Hill; Richard E. Repp, San Jose; Steven H. Bietzer, Sunnyvale, all of Calif.

[73] Assignee: Portola Packaging, Inc., San Jose, Calif.

[21] Appl. No.: 329,210

[22] Filed: Oct. 26, 1994

Related U.S. Application Data

[63] Continuation-in-part of Ser. No. 29,177, Mar. 10, 1993, Pat. No. 5,456,376, which is a continuation-in-part of Ser. No. 830,133, Jan. 31, 1992, Pat. No. 5,267,661, which is a continuation-in-part of Ser. No. 772,945, Oct. 8, 1991, Pat. No. 5,213,224, which is a continuation-in-part of Ser. No. 565,638, Aug. 9, 1990, Pat. No. 5,190,178.

[51] Int. Cl.[6] ..... B65D 39/00

[52] U.S. Cl. ..... 215/256; 215/44

[58] Field of Search ..... 215/256, 44, 45

[56] References Cited

U.S. PATENT DOCUMENTS 3,367,524 2/1968 Lake ..... 215/256

4,567,992 2/1986 Davis ..... 215/222

FOREIGN PATENT DOCUMENTS 11668 10/1956 Germany ..... 215/256

*Primary Examiner*—Stephen K. Cronin

*Attorney, Agent, or Firm*—Julian Caplan; Flehr Hohbach Test Albritton & Herbert LLP

[57] ABSTRACT

A tamper-evident closure and specially shaped container neck. The closure has an upper skirt with an engagement structure on the interior of the skirt which cooperates with an engagement structure on the neck. The closure and neck have tamper-evidencing portions which interengage when the closure is seated on the neck to prevent removal of the closure with the tamper-evidencing portions intact. A tear tab reinforced with a vertically extending bend is joined to the tamper-evidencing portion of the closure. The neck has at least one notch shaped and positioned to receive the tear tab when a cap is applied to the neck.

27 Claims, 2 Drawing Sheets

TABS FOR CONTAINER CLOSURES AND CONTAINER NECK

CROSS-REFERENCE TO RELATED APPLICATIONS

This application is a continuation-in-part of U.S. Application, Ser. No. 08/029,177, filed Mar. 10, 1993, now U.S. Pat. No. 5,456,376, which is a continuation-in-part of U.S. Application, Ser. No. 07/830,133, filed Jan. 31, 1992, now U.S. Pat. No. 5,267,661, which is a continuation-in-part of U.S. Application, Ser. No. 07/772,945, filed Oct. 8, 1991, now U.S. Pat. No. 5,213,224, which is a continuation-in-part of U.S. Application, Ser. No. 07/565,638, filed Aug. 9, 1990, now U.S. Pat. No. 5,190,178. The disclosures of the above-mentioned applications are hereby incorporated herein by reference.

BACKGROUND OF THE INVENTION

1. Field of the Invention

The present invention relates in general to a tamper-evident closure system for sealing a container. More particularly, the present invention relates to a an improved neck finish and a closure with a reinforced tear tab.

2. Description of the Related Art

Many tamper-evident closure structures available in the prior art have a removable portion or lower skin frangibly attached to the upper skirt of the cap. The removable portion typically includes a locking structure, such as ratchet teeth or beads, which cooperate with the locking structure on the neck to prevent removal of the closure so long as the removable potion is intact. A tear tab depending from the lower skirt may be gripped by a user to separate the removable portion from the remainder of the cap when opening the container. The removable portion may be formed with a vertical line of weakness adjacent the tear tab to facilitate opening of the container. Depending upon the material used to manufacture the cap, the tear tab may be quite flexible. A vertical rib formed on the back surface of the tab ensures that the removable portion ruptures along the vertical line of weakness when a user grips the tab and pulls it away from the container neck.

During shipment and storage of the cap, the standard tear tab may tend to bend under the weight of the cap and, after a period of time, may become set in the bent position. The deformed tab may interfere with the capping process and require that the cap be discarded. In some capping processes, the tear tab is used to orient the cap relative to the neck. As the cap travels down a chute, the tab extends into a space between parallel rails to position the cap so that it is discharged from the chute in a pre-determined orientation. A tab which has been bent inwardly may fail to engage the parallel rails of the chute, with the cap then having any orientation on discharge from the chute. As a result, many of the advantages of providing the cap with a predetermined orientation may be lost. If the tear tab is deformed outwardly, the cap may not roll properly during the capping process. Also, inward or outward bending of the tabs may cause difficulties in properly conveying the closures during the capping process.

A cap having a tab with sufficient rigidity to retain its original shape would avoid these problems occasionally encountered during capping processes. Moreover, a reinforced tab would assist the user in removing the lower skirt from the cap when opening the container. Many types of closures, including for example snap-on, snap-off structures and snap-on, screw-off structures, would benefit from the use of a reinforced tab.

The snap-on, screw-off structures available in the prior art are of two general types—those having thread engagement as initially applied, and those without initial thread engagement. Systems having partial to full thread engagement on initial application have several advantages over the no-thread system, including the ability to effectively use a liner to seal the neck of the container. The height of the cap and the inner plug, if used, may be reduced. Consumer confusion is also eliminated, since the cap is initially removed from the container by twisting. However, the initial thread engagement systems do not offer the manufacturing and application advantages available with the no-thread system. With some systems, the capping machinery used to apply the closure must twist the closure relative to the container at some point during the application process in order to seat the cap on the neck. An example of such a closure is shown in U.S. Pat. No. 4,625,875 to Carr. Achieving full thread engagement without the use of complicated machinery to twist the cap relative to the neck is preferred.

One modification of this invention provides a snap-on, screw-off system with initial thread engagement by reason of a unique thread design, a unique tamper-evident band and optional means for orienting the closure and container threads to achieve registration prior to straight axial application. The neck is constructed to cooperate with either the standard or reinforced tear tab of a closure to ensure that the cap is aligned with the neck for full thread engagement. The neck construction offers the additional advantage of enabling a consumer to easily grip the tab and open the container. The present invention offers considerable advantages over prior structures as is evident from the description of the related art and the following description of the invention.

SUMMARY OF INVENTION

The present invention comprises an improved closure or cap and an improved neck finish. The cap skirt and neck finish are of the type having cooperatively shaped engagement structures, such as mating threads, one or more locking beads, etc., which hold the cap on the neck. A tamper-evidencing portion of the neck interengages a tamper-evidencing portion of the cap to prevent removal of the closure with the tamper-evidencing portions intact, providing evidence of tampering with the contents of the container.

The closure includes a tear tab which may be used to remove the tamper-evidencing portion from the cap skirt. A vertically extending bend increases the rigidity of the tab so that the tab will retain its original shape. The reinforced tab is easier to grip and, if the closure is oriented relative to the neck, assists in aligning the closure with the neck. The tamper-evidencing portion on the cap preferably includes a line of weakness adjacent the tear tab. A consumer removes the tamper-evidencing portion from the closure by pulling the tab and rupturing the line of weakness and the frangible section between the cap skirt and the tamper-evidencing portion. Since the tamper-evidencing portion is at least partially removed from the closure, tampering with the contents of the container may be detected by even the inattentive consumer.

If the cap skirt and neck finish are formed with mating threads, the threads may be of such shape that the cap may be applied in a simple downward vertical movement without relative rotation, the cap skirt flexing sufficiently to permit the threads to slip past each other. The interengagement of the threads requires that the closure be unscrewed for removal from the container. The closure may be formed having an orientation structure, such as the tear tab, for aligning the closure relative to the container. Similarly, the container may include an orientation structure, such as a non-circular cross section, for orienting the container with respect to the closure. The orientation features may be used to achieve complete thread engagement during straight axial application. Achieving full thread engagement allows use of lined closures for extra seal security or reduction in seal plug and closure height.

The improved neck finish has at least one notch shaped and positioned to receive the tear tab of a cap when the cap is seated on the neck. The neck may be used with a cap having a reinforced tab or the standard tear tab known in the art. If the tab is not completely aligned with the notch, the tab may be biased into the notch as the cap is moved downwardly onto the neck so that the cap and neck are fully aligned. A tab positioned in the notch is also easy to grip and pull away from the neck. A cap having a reinforced tab offers the advantage that the increased rigidity of the reinforced tab facilitates adjustment of the cap relative to the neck. The improved neck finish and the closure tear tab provide for full thread engagement when the snap-on, screw-off closure is moved downward onto the neck.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
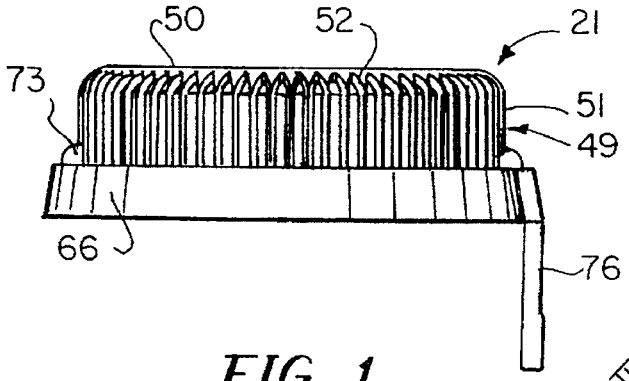
FIG. 1 is a side elevational view of a cap.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Directing attention to FIGS. 1–8, closure 21, hereinafter described in detail, is used with a container neck 22. Neck 22 has a central opening 23 surrounded by a lip 24. It should be understood that the term "lip" used herein refers to the edge of the neck around the opening, which may be in the form of an annular rim, a flange, or any other shape known in the art. In the embodiment shown in FIGS. 1–8, lip 24 is in the shape of a downward/outward slanted lip flange. A neck stretch 28 depends from the lip 24 and terminates in a horizontal upper shoulder 27. The interior of the neck 22 forms no part of the present invention. When neck 22 is formed with a blow-molded finish, the interior contour of the neck tends to follow that of the exterior. Other types of bottles may be used, in which case the shape of the neck interior may vary from the exterior contour of the neck.

The exterior of neck stretch 28 includes at least one first engagement means as for example threads 30. In the modification shown in FIGS. 1–8, two continuous threads designated 30*a* and 30*b* extend helically around the exterior of the neck stretch. The finish has twelve threads per inch with a double lead, each thread being six pitch and extending slightly in excess of 360° of a full thread. The extent of the threads may be greater than 360° for increased thread engagement. Moreover, the finish may be provided with additional thread leads or a different linear thread density (threads per inch). The threads may be interrupted instead of continuous. Alternatively, other engagement means such as one or more locking beads or a groove formed in the neck stretch exterior may be substituted for the threads 30*a* and 30*b*.

Figure 6:
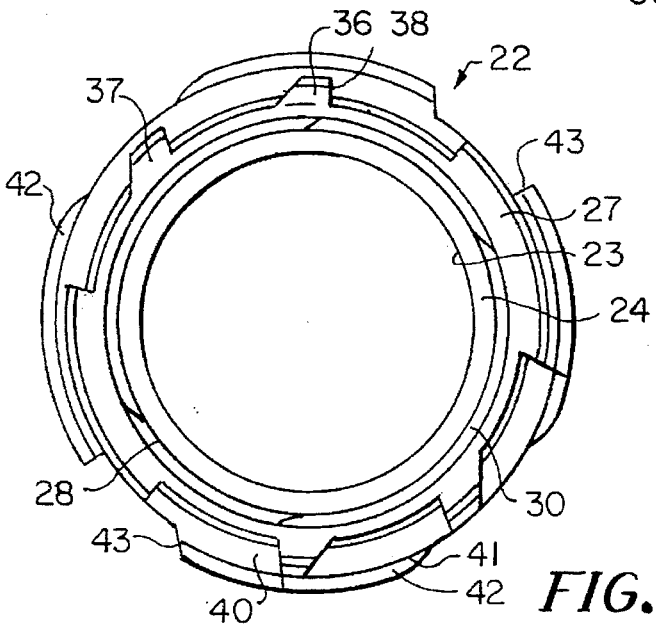
FIG. 6 is an enlarged top plan view of a neck.
Figure 5:
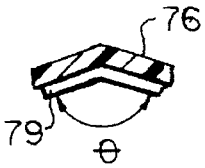
FIG. 5 is an enlarged, fragmentary sectional view taken along line 5—5 of FIG. 4.
Figure 7:
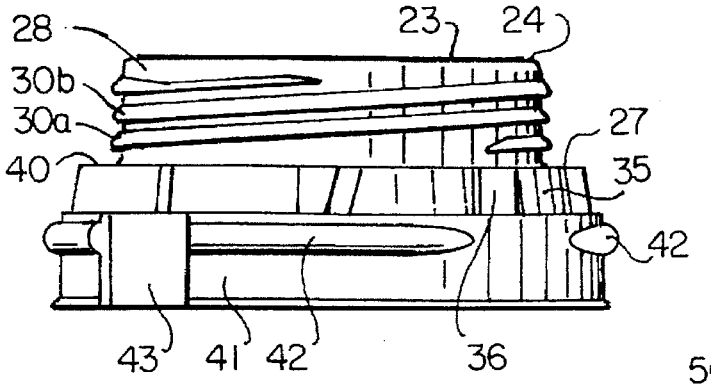
FIG. 7 is a side elevational view of a neck.
Figure 8:
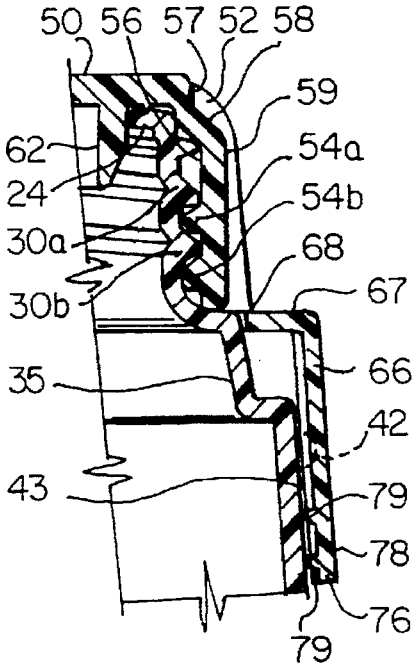
FIG. 8 is an enlarged fragmentary sectional view of the cap applied to the neck.

Neck 22 includes tamper-evidencing means which cooperate with tamper-evidencing means on the cap 21, hereinafter described, to provide evidence indicating whether a container has been previously opened. The cooperatively formed tamper-evidencing means alert a consumer to potential tampering with and/or contamination of the contents of the container. A locking wall 35 below the shoulder 27 is formed with at least one external tooth 36. As shown in FIGS. 6–8, neck 22 includes two groups of three teeth disposed on opposite sides of the container. However, the number of teeth may be increased or decreased and the grouping of the teeth may be modified. The locking wall 35 and the outer surface of teeth 36 slant downward/outward at an angle of approximately 10°. Each tooth 36 has a top surface 37 which may be co-planar with the surface of shoulder 27. The front edges 38 of teeth 36 are disposed at varying angles from about 45° to about 0° relative to a radial line dram perpendicular to the vertical axis of the neck 22.

The locking wall 35 terminates in a generally horizontal lower shoulder 40. A lower vertical stretch 41 depending from the lower shoulder 40 merges with the container. Several bumper ting segments 42 are formed on the vertical stretch 41 to facilitate gripping of the container during filling and loading, and to provide the neck with a certain amount of vertical flexibility during capping.

Two vertical notches 43 are formed in vertical stretch 41 on opposite sides of the neck 22. The notches 43 are positioned to receive the tear tab of a cap when the cap is seated on the neck. This feature is of particular advantage when neck 22 is used with a snap-on, twist off type of cap, examples of which are shown in U.S. Pat. Nos. 5,190,178, 5,213,224, and 5,267,661. Preferably, the tear tab is positioned in the notch before the closure threads engage the threads on the neck, facilitating orientation of the cap relative to the neck. Orienting a snap-on, twist-off closure relative to the neck ensures that complete thread engagement is achieved during straight axial application of the cap to the neck. With full thread engagement, seal discs or lined closures may be used for extra seal security. In addition, the height of the closure and inner seal plug, if present, may be reduced. The locking means on the neck and cap, such as teeth 36 and complementary teeth formed on the closure interior, are similarly fully interengaged. The notches 43 offer the additional advantages of enabling the consumer to easily grip the tab to initially open the container. Although the neck shown in FIGS. 6–8 has two diametrically opposed notches, it should be understood that forming only one or more than two notches in vertical stretch 41 is within the scope of the present invention.

Cap 21, shown particularly in FIGS. 1 to 5, has a top 50 and a skirt 49 depending from the peripheral edge of the top. While the top 50 of the depicted embodiment is in the form of a generally flat disc, the top may also have other shapes. The skirt 49 includes an upper skirt 51 with a plurality of spaced vertical ribs 52 around the skirt exterior which enable the user to easily grip and remove cap 21 from the container.

The upper skirt interior includes at least one second engagement means, such as threads 54, shaped to engage the first engagement means or threads 30 on the exterior of the neck stretch 28. Two continuous threads **54*a* and 54*b* extend helically around the interior of the upper skirt in the depicted embodiment. The threads 54*a* and 54*b* are double lead and each extend in excess of 180° (i.e. 200°) of the interior circumference of the cap. In other forms of the invention, the cap 21 may have additional thread leads or a different linear thread density (threads per inch). The threads may be interrupted instead of continuous or the threads 54*a* and 54*b* may be replaced by other engagement means such as a groove formed to interengage threads 30** on the neck.

Figure 4:
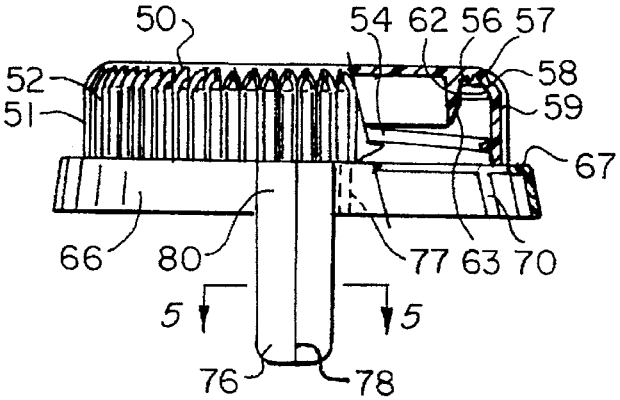
FIG. 4 is a side elevational view of the cap, the cap being partially broken away in section to reveal internal construction.
Figure 3:
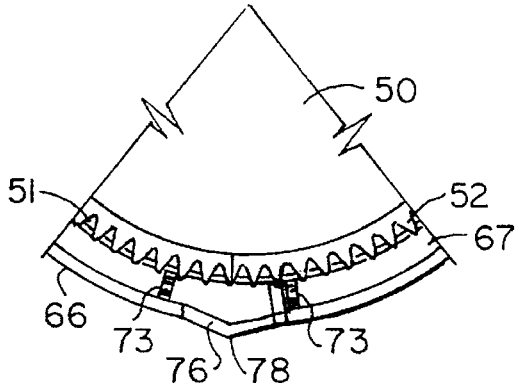
FIG. 3 is a fragmentary enlarged top plan view of the cap.

An inward projecting portion 56 of upper skirt 51 defines the minimum interior circumference of the cap. Preferably, the minimum interior circumference of the cap is less than the exterior circumference of the neck stretch 28 to form a tight fit between the interior of the upper skirt 51 and the exterior of neck stretch 28. As shown in FIG. 4, upper skirt 51 includes an upper stretch 57, a downward/outward slanted stretch 58 and a lower stretch 59. An internal shoulder formed at the intersection of upper stretch 57 and slanted stretch 58 defines the inward projecting portion 56. When the cap is applied, the inward projecting portion contacts the upper edge of the neck stretch 28 and biases the upper stretch 57 outward, stretching the top 50 of the cap and forming a tight fit between the upper skirt 51 and the neck stretch 28.

A plug or inner skirt 62 depends from the underside of the top 50. The plug 62 is spaced inwardly from the upper skirt 51 to fit inside the neck opening 23. The outer bottom edge of the plug 62 is preferably formed with a bevel 63 to facilitate seating of the cap 21 on the neck. The plug 62 is pulled against the interior edge of the lip 24 as the cap 21 seats on the neck and the neck stretch 28 biases the upper stretch 57 outward. With a blow molded finish, neck opening 23 is formed using a blow mold pin which provides the interior edge of the lip 24 with a seamless surface. Since the exterior edge of the plug 62 is also seamless, pulling the plug against the interior edge of the lip forms a substantially liquid impervious seal between the cap 21 and the neck 22.

The cooperation between inward projecting portion 56, the plug 62 and the interior edge of lip 24 provides the closure system with a substantially leak tight seal. The seal between the plug exterior and the lip is of particular interest when the neck has a blow molded finish. However, it should be understood that various other sealing means may be used to seal the container.

Figure 2:
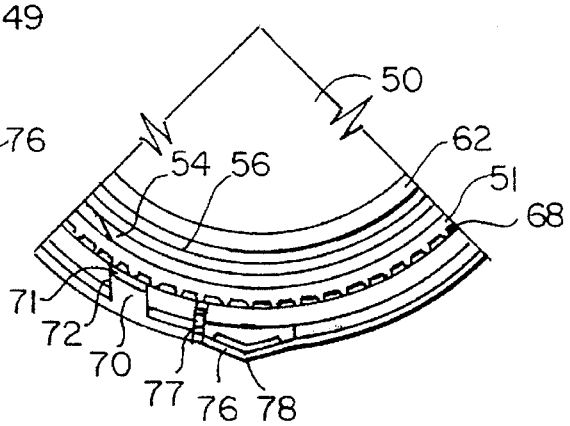
FIG. 2 is a fragmentary enlarged bottom plan view of the cap.

Cap 21 includes tamper-evidencing means which provides an indication that the cap has been previously removed from the container. In the embodiment shown in FIGS. 1–8, the cap skirt 49 includes a removable potion or lower skirt 66. The lower skirt 66 is frangibly joined to the upper skirt 51 by a plurality of bridges 68. As shown in FIGS. 2 and 4, the bridges constitute the lower edges of ribs 52. Depending upon the strength and number of frangible connections or bridges 66 incorporated in the cap, the bridges may prevent removal of the cap without separating the lower skirt 66 from the upper skirt 51, or the bridges may rupture when one attempts to initially remove the closure 21 from the neck 22. With the first alternative, the absence of lower skirt 66 indicates that the container has been opened, while with the second alternative the ruptured bridges provide evidence that the container had been opened.

Lower skirt 66 includes an inward extending shoulder 67 frangibly connected to upper skirt 51 by the bridges 68. The shoulder substantially prevents the accumulation of foreign particles between the lower skirt and locking wall 35 of the neck. However, in other modifications of the closure system the lower skirt may take on other shapes. For example, the lower skirt may have a generally planar cross section. The bridges and the voids therebetween are sometimes referred to herein as "horizontal lines of weakness." Instead of the bridges 68 interconnecting the upper and lower skirts 51 and 66, cap 21 may include other frangible means such as a continuous thinned tear line around the circumference of the cap. One advantage of using the frangible connections or bridges is that cap 21 may be fabricated from a wide range of materials.

The interior of lower skirt 66 includes locking means which cooperate with the locking means on the neck to prevent removal of the cap without separation of the lower skirt from upper skirt 51. One such locking means is provided by internal teeth 70 shaped and positioned to engage the external teeth 36 on neck 22. After application of the cap, the inner edges 71 of the teeth 70 are positioned close to locking wall 35. The leading edges 72 of teeth 70 are each formed at an angle of approximately 45° to a radial line, thereby ensuring good interlock with the complementary surface 38 of teeth 36 on the neck. The angular relationship between teeth 36 and teeth 70 biases the cap 21 into a more secure locking arrangement with the neck 22.

Vertical fins 73 are formed between the shoulder 67 and upper skirt 51 to provide further protection against tampering with the container. The fins 73 prevent the upward deformation of the lower skirt 66. If an attempt is made to pry the lower skirt upward, the fins ensure that bridges 68 rupture, providing evidence of potential tampering.

Tear tab 76 joined to lower skirt 66 provides means for removing the lower skirt from cap 21. Tab 76 extends downwardly from the lower edge of lower skirt 66 and is preferably positioned adjacent a vertically extending weakened line 77 in lower skirt 66. The weakened line 77 may be provided by a continuous thin tear line extending through the lower skirt, as shown in FIG. 2, or the weakened line 77 may alternatively be formed using other frangible means known in the art. Although use of the weakened line is optional, splitting the lower skirt when the cap is initially removed offers several advantages. Removing the lower skirt from around the neck provides clearly visible evidence that the container has been previously opened. The weakened line 77 facilitates separation of the lower skirt from the upper skirt and splitting lower skirt 66 eliminates the dangers an intact band may present to wildlife. As shown particularly in FIGS. 4 and 5, tab 76 has a longitudinal axis and wall portions extending outwardly from the axis and terminating in a plane spaced from the axis to form a vertically or longitudinally extending bend 78. Bend 78 reinforces and increases the rigidity of the tab 76. Because of the reinforcement provided by bend 78, the tab will substantially resist deformation during packing and shipment so that the cap may be applied to the neck 22 without difficulty. The shape and rigidity of tab 76 enable a user to more easily grip the tab and remove lower skirt 66. If the cap 21 is oriented relative to the container before application, the reinforced tab 76 facilitates the orientation of the cap. By forming the tab with bend 78, tab 76 thereby offers several advantages over the standard tab. In the depicted embodiment, the angle θ of bend 78 is approximately 145°, although the size of the angle may be increased or decreased. For example, a bend having an angle within the range of approximately 90° to 170° is within the scope of the present invention. Bend 78 may be angular as shown, providing tab 76 with an arrow-shaped cross section, or it may be rounded or curved. The apex of the bend 78 is preferably positioned on the exterior of the cap, although if desired the bend apex may be on the interior of the cap.

The underside of tab 76 is formed with a pair of vertically spaced, transverse ribs 79. The ribs 79, which have the same shape as tab 76, improve the ability of a user to grip the tab. The ribs 79 also raise the lower end of the tab from the neck exterior so that a user may slip a fingernail below the tab and easily lift the tab from the neck. As shown particularly in FIG. 4, lower skirt 66 has a bent portion 80 coinciding with and extending vertically from bend 78 of the tab. Bent portion 80 generally follows the shape and contour of the bend 78 in the tab. Forming the lower skirt with bent portion 80 is optional, although it facilitates the formation of cap 21 and improves the overall aesthetic appearance of the cap.

When used with neck 22 of the embodiment shown in FIGS. 6–8, the reinforced tab cooperates with the neck to ensure that the cap is fully seated on the neck. As shown in FIG. 8, tab 76 is positioned in one of the notches 43 when cap 21 is seated on neck 22. If tab 76 is not fully aligned with a notch 43, the rigid tab may contact bumper ring segment 42, causing the cap to rotate slightly so that the tab is directed into the notch 43. In addition, the placement of tab 76 in notch 43 assists the user in gripping the tab 76 for removal of lower skirt 66.

Figure 9:
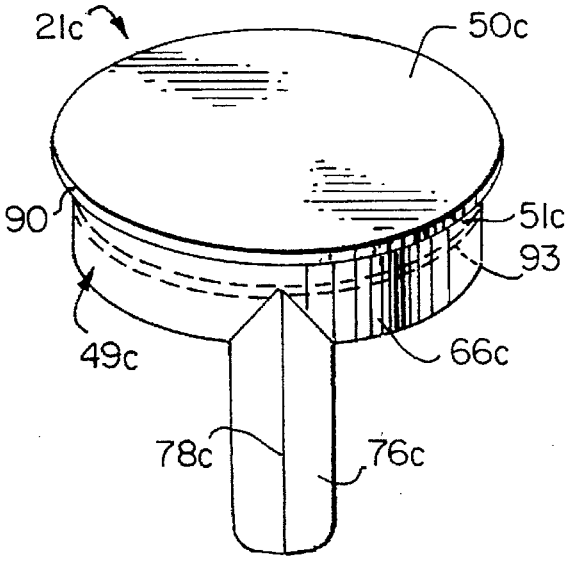
FIG. 9 is an isometric view of an alternative embodiment of a cap.
Figure 10:
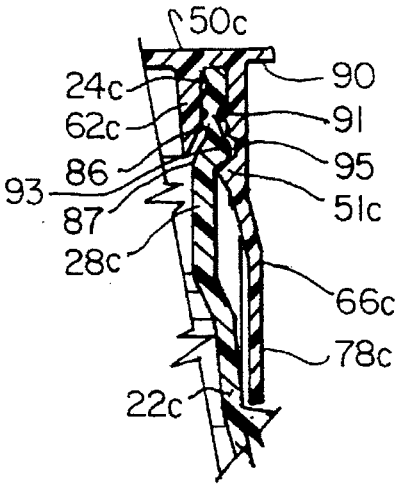
FIG. 10 is an enlarged fragmentary sectional view of the cap of FIG. 9 applied to a neck.

Another modification of the cap and neck are shown in FIGS. 9 and 10. Several elements, which are substantially similar to those of the previously described embodiment, are identified by the original reference numeral and "c". Cap **21*c* is applied to a standard neck 22*c* having a lip 24*c* and a neck stretch 28*c* below the lip. The neck stretch 28*c* is formed with a shoulder 86 and an external bead 87 provide the engagement means on the neck stretch 28*c***.

Cap **21*c* has a top 50*c*, a skirt 49*c* with an upper skirt portion 51*c* depending from the top, and an inner skirt or plug 62*c* spaced inwardly from the upper skirt 51*c*. A thin, flexible peripheral flange 90 on the top 50*c* may be used to pull the cap off the neck. The flexibility of the flange 90 prevents removal of the cap 21*c* with the tamper-evidencing means of the cap still intact. The interior of upper skirt portion 51*c* includes engagement means, such as an internal locking bead 91, for retaining the cap on the neck. The locking bead 91 may be interrupted or continuous, although interruptions in the beads are preferred as they permit the upper skirt to stretch during application of the cap. When the cap is seated on the neck 22*c*, the bead 91 is seated beneath the shoulder 86** on the neck.

Cap **21*c* includes tamper-evidencing means as for example a removable lower skirt portion 66*c*. An internal bead 93 on the interior of the lower skirt portion 66*c* engages the external bead 87 on the neck to prevent removal of the cap with the lower skirt intact. An internal horizontal scoreline 95 frangibly connects the removable portion 66*c* to upper skirt portion 51*c*. The scoreline 95 may be provided by a continuous thinned tear line around the circumference of the cap or other frangible means known in the art may be used to form the horizontal scoreline 95. The lower skirt portion 66*c* may be separated from the upper skirt portion 51*c* by tearing along the scoreline 95** as is known in the art.

A reinforced tear tab **76*c* with a vertically extending bend 78*c* depends from the lower edge of lower skirt portion 66*c*. The tab 76*c* may be used to pull the lower skirt 66*c* from the upper skirt 51*c*. As was described in relation to the previous modification, bend 78*c* increases the rigidity of the tab 76*c* to ensure that the tab retains it original shape and to improve the effectiveness of the tab in assisting with the removal of lower skirt portion 66*c***.

The cap **21*c* is moved in a downward axial direction to seat the cap on the neck 22*c*. The upper skirt 51*c* and the lower skirt 66*c* stretch as the cap is seated on the neck, allowing locking bead 91 to slip beneath shoulder 86 and locking bead 93 to slip past external locking bead 87. Until lower skirt portion 66*c* is at least partially separated from the upper skirt, the cap 21*c* may not be removed from the neck 22*c*** without deforming the neck. Thus, tampering with the contents of the container may easily be detected.

PREFERRED OPERATION

In a preferred form of the present invention, cap 21 is seated on neck 22 through the application of a direct axial downward force as follows. After the container has been filled, it is transported through a capping machine. The structure of capping machines is well known in the bottling art. As is well understood in the art, and in a manner similar to that whereby push-on, pull-off caps are applied, caps 21 are fed one at a time out of a bowl in the capping machine along a chute. One type of chute is formed with a space between parallel rails, with tear tab 76 orienting the caps for uniform discharge in a pre-determined orientation relative to the containers passing therebelow by fitting into the space between the rails. Preferably each container has a non-circular cross section, some other variation from a round shape, or some other orientation means which permits the container to be oriented relative to cap 21. The container travels along a conveyer belt below the capping machine. Guide rails adjacent the conveyor belt directionally align the non-circular cross section of the container relative to the tear tab 76 of the cap. Thus, the cap 21 and neck 22 may be conveniently oriented relative to one another by the conventional capping machine and conveyor belt system. Threads 30 and 54 are in vertical alignment, ensuring full thread engagement and complete interengagement of the teeth 36 and 70. In other modifications of the invention, the teeth 36 and 70 need not be vertically aligned.

An axially downward force is applied to the cap, pushing the cap onto the neck without externally imposed relative rotation of the cap and container. Threads **54*a* and 54*b* slip over threads 30*a* and 30*b*, the slanted surfaces of the neck threads facilitating such movement. The cap is sufficiently resilient so that it expands outward to permit the threads to slip. As cap 21 seats on the neck, teeth 70 fall behind teeth 36, providing interengagement between teeth 36 and teeth 70. After the cap has been fully seated on neck 22, it may not be removed without providing evidence of tampering. The interengagement between teeth 36 and 70 prevents unscrewing of the cap from the container, while the interengagement between the threads prevents lifting of cap 21 off neck 22**.

As is apparent from the foregoing discussion, the invention provides a tamper-evident closure system. The reinforced tab resists the bending or deformation which may occur during shipment and storage, ensuring that the cap may be satisfactorily applied to a container neck. If the cap is of the type which is positioned in a predetermined orientation prior to application, tab 76 facilitates orientation of the cap as it seats on the container neck. The reinforced tab allows a user to more easily grip the tab and remove the lower skirt 66 when opening the container. The notches 43 in the neck facilitate orientation of a snap-on, twist-off type of closure as it is seated on the neck.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A container closure for a container neck, said neck having an opening, a lip surrounding said opening, a neck stretch below said lip, said neck stretch having an exterior, at least one first engagement means on said exterior of said neck stretch;

said closure having a top, a skirt depending from said top, said skirt having an interior, at least one second engagement means on said interior of said skirt shaped to engage said first engagement means, said skirt having frangible means extending horizontally around said skirt and a removable portion below said frangible means;

the improvement in said closure comprising a tab connected to said removable portion of said skirt, said tab having a longitudinal axis and wall portions extending outwardly from said axis and terminating in a plane spaced from said axis to define a longitudinally extending bend for reinforcing said tab.

2. The closure of claim 1 in which said tab includes at least one transversely extending rib.

3. The closure of claim 1 in which said removable portion of said skirt has a bent portion formed therein, said tab being positioned with said bend substantially aligned with said bent portion in said removable portion.

4. In combination, the closure of claim 1 and said neck, said neck having at least one notch shaped and positioned to receive said tab, said tab being positioned within said notch when said closure is seated on said neck.

5. The closure of claim 1 in which said closure includes a line of weakness extending through said removable portion, said tab being positioned adjacent said line of weakness.

6. The closure of claim 1 in which said frangible means comprises a plurality of radially spaced bridges.

7. The closure of claim 1 in which said frangible means comprises a continuous thin tear line.

8. The closure of claim 1 in which said first engagement means and said second engagement means are screw threads.

9. The closure of claim 1 in which said second engagement means includes at least one bead on said skirt, said bead being shaped to engage said neck stretch when said closure is applied to said neck.

10. The closure of claim 1 in which said first engagement means extends helically around said exterior of said neck stretch and said second engagement means extends helically around said interior of said skirt.

11. The closure of claim 10 in which said first engagement means and said second engagement means are shaped to slip past one another and interengage when said closure is applied to said neck without relative rotation of said closure and said neck.

12. A container closure for a container neck, said neck having an opening, a lip surrounding said opening, a neck stretch below said lip, said neck stretch having an exterior, at least one first engagement means on said exterior of said neck stretch;

said closure having a top, a skirt depending from said top, said skirt having an interior, at least one second engagement means on said interior of said skirt shaped to engage said first engagement means, said skirt having frangible means extending horizontally around said skirt and a removable portion below said frangible means;

the improvement in said closure comprising a tab connected to said removable portion of said skirt, said tab having a longitudinally extending bend formed therein for reinforcing said tab; said longitudinally extending bend having an angle of approximately 145°.

13. A container closure for a container neck, said neck being of the type having an opening, a lip surrounding said opening, a neck stretch below said lip, said neck stretch having an exterior, at least one first engagement means on said exterior of said neck stretch, and first tamper-evidencing means;

said closure being of the type having a top, an upper skirt depending from said top, said upper skirt having an interior, at least one second engagement means on said interior of said upper skin shaped to engage said first engagement means, and second tamper-evidencing means frangibly connected to said upper skin;

the improvement in said closure comprising said second tamper-evidencing means having a tab for removal of said second tamper-evidencing means from said upper skin, said tab having a longitudinal axis and wall portions extending outwardly from said axis and terminating in a plane spaced from said axis to define a longitudinally extending bend for increasing the rigidity of said tab.

14. The closure of claim 13 in which the angle of said bend is between approximately 90° and 170°.

15. In combination, the closure of claim 13 and said neck, said neck having at least one notch formed therein, said notch being shaped and positioned to receive said tab, said tab being positioned within said notch when said closure is seated on said neck.

16. The closure of claim 13 in which said second engagement means includes at least one bead on said interior of said upper skirt.

17. The closure of claim 13 in which said second tamper-evidencing means includes a lower skirt below said upper skirt, said lower skirt having an interior and locking means on said interior of said lower skirt.

18. The closure of claim 17 in which said locking means comprises at least one internal tooth on said interior of said lower skirt, said tooth being shaped and positioned to engage said first tamper-evidencing means on said neck.

19. The closure of claim 17 in which said locking means comprises at least one internal bead on said interior of said lower skirt, said bead being shaped and positioned to engage said first tamper-evidencing means on said neck.

20. The closure of claim 13 in which said first engagement means extends helically around said exterior of said neck stretch and said second engagement means extends helically around said interior of said upper skirt.

21. The closure of claim 20 in which said first engagement means and said second engagement means are shaped to slip past one another and interengage when said closure is applied to said neck without relative rotation of said closure and said neck.

22. A container neck for a container closure, said closure having a top, an upper skirt depending from said top, said upper skirt having an interior, at least one first engagement means on said interior of said upper skirt, first tamper-evidencing means frangibly connected to said upper skirt, and a tenor tab joined to said first tamper-evidencing means, said neck having an opening, a lip surrounding said opening, an upper neck stretch depending from said lip, said upper neck stretch having an exterior, at least one second engagement means on said exterior of said neck stretch, second tamper-evidencing means below said upper neck stretch, and a lower neck stretch below said second tamper-evidencing means, said lower neck stretch having an exterior, the improvement in said neck comprising at least two diametrically opposed notches formed in said lower neck stretch portion, said notches being shaped and positioned to receive said tab when said closure is seated on said neck.

23. The neck of claim 22 in which said second tamper-evidencing means includes a locking wall portion below said upper neck stretch, said locking wall portion having at least one external tooth shaped and positioned to engage said first tamper-evidencing means on said closure when said closure is seated on said neck.

24. The neck of claim 22 in which said neck has at least one bumper ring segment on said exterior of said lower neck stretch, said notch being defined by an interruption in said bumper ting segment.

25. The neck of claim 24 in which said bumper ting segment and said notch are shaped and positioned such that when said tab contacts said bumper ring segment during application of said closure to said neck, said tab is biased into said notch, whereby said closure is fully aligned with said neck.

26. The neck of claim 22 in which said second engagement means extends helically around said exterior of said upper neck stretch.

27. The neck of claim 26 in which said second engagement means is shaped to slip past and engage first engagement means of a closure when said closure is applied to said neck without relative rotation of said closure and said neck.

* * * * *

UNITED STATES PATENT AND TRADEMARK OFFICE

CERTIFICATE OF CORRECTION

PATENT NO. : 5,630,520

DATED : May 20, 1997

INVENTOR(S) : Luch et al.

It is certified that error appears in the above-identified patent and that said Letters Patent is hereby corrected as shown below:

In claim 13, line 10, change "skin" to --skirt--.
In claim 13, line 12, change "skin" to --skirt--.
In claim 13, line 16, change "skin" to --skirt--.
In claim 24, line 4, change "ting" to --ring--.
In claim 25, line 1, change "ting" to --ring--.

Signed and Sealed this

Seventh Day of March, 2000

*Attest:*

*Attesting Officer*

Q. TODD DICKINSON

*Commissioner of Patents and Trademarks*